United States Patent [19]

Forkner et al.

[11] Patent Number: 4,777,711

[45] Date of Patent: Oct. 18, 1988

[54] STACKER

[76] Inventors: Robert R. Forkner, 6702 Palma, Yorba Linda, Calif. 92686; Thomas A. Ferree, 500 W. Maxzim Ave., Fullerton, Calif. 92632

[21] Appl. No.: 857,961

[22] Filed: May 1, 1986

[51] Int. Cl.[4] ..... B21F 11/00; B21F 23/00

[52] U.S. Cl. ..... 29/566.3; 29/564.4; 83/151; 83/84; 81/9.51; 414/77; 414/80; 414/745; 140/140

[58] Field of Search ..... 83/84, 151, 155.1, 158, 83/23, 29; 81/9.51; 140/140; 198/457; 414/77, 80, 81, 745; 29/566.3, 564.4, 566.1

[56] References Cited

U.S. PATENT DOCUMENTS

| | | | |
|---|---|---|---|
| 4,156,961 | 6/1979 | Agoh | 81/9.51 |
| 4,256,427 | 3/1981 | Patel | 83/157 X |
| 4,266,455 | 5/1981 | Ago | 83/151 X |

*Primary Examiner*—Donald R. Schran
*Attorney, Agent, or Firm*—William W. Haefliger

[57] ABSTRACT

A stacker for a flexible strand, such as a flimsy wire, comprises:

(a) a conveyor having an elongated endwise traveling stretch onto which the strand is fed to be carried endwise on the stretch, (b) a gripper to grip a trailing portion of the strand as forward extent of the strand is carried endwise on the stretch, (c) structure to effect displacement of the gripper to a position locating the gripped portion of the strand sufficiently out of alignment with the stretch that the strand is progressively pulled sidewardly off the stretch in response to endwise travel of the stretch relative to the strand.

Pins may travel with the conveyor to displace the strand off the stretch; and the strand in wire form may be cut and stripped, as it is fed toward the conveyor and gripper. A collector collects strands that are displaced off the conveyor.

22 Claims, 8 Drawing Sheets

FIG. 2.
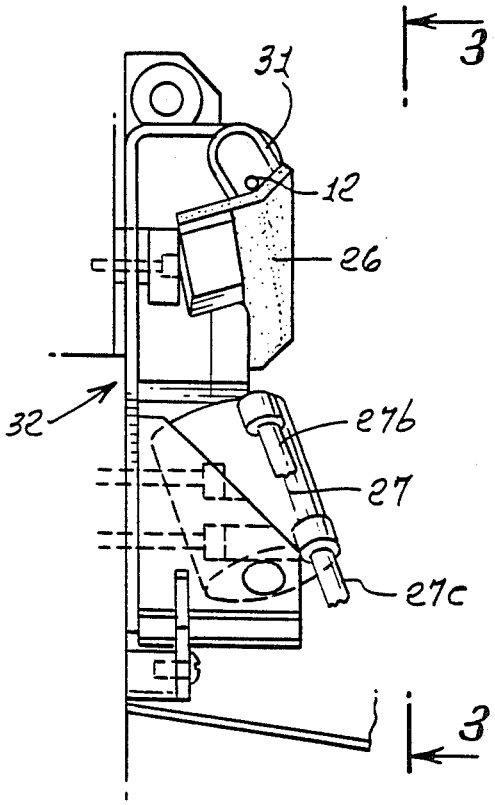
FIG. 5.
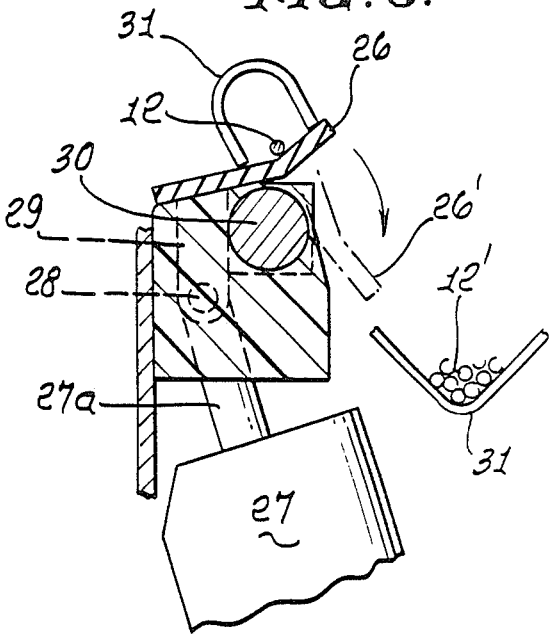
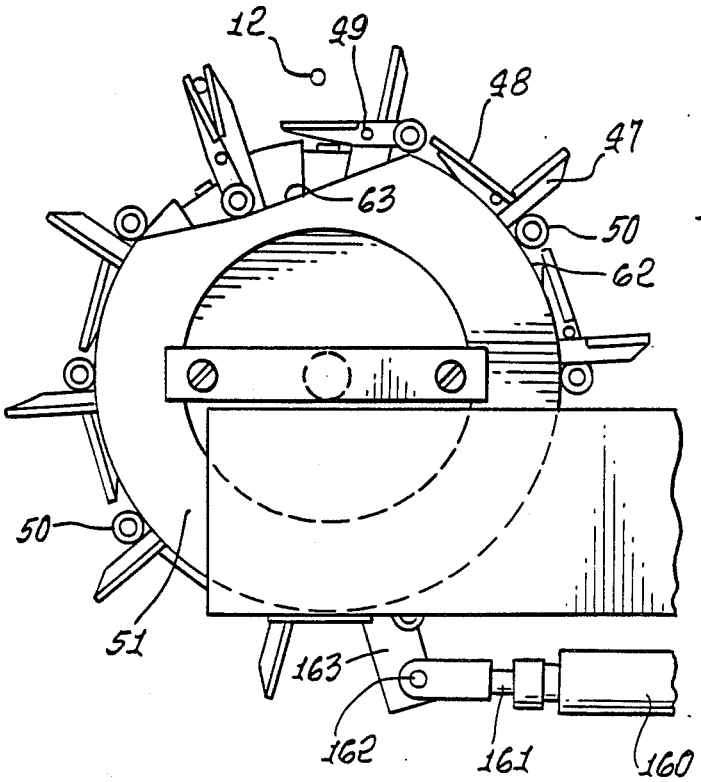
FIG. 8.

STACKER

BACKGROUND OF THE INVENTION

This invention relates generally to handling of wire strands as for example are used in wire harnesses, and for other purposes; more specifically it concerns stacking of such strands, as for example flimsy wire strands, which have been cut to length, and/or stripped of insulation at strand ends, in conjunction with such cutting and/or stripping.

The handling of elongated flimsy wire strands, following cutting and/or stripping; and particularly predetermined stacking of such strands is a problem, specfically in respect of equipment that processes the wire at high speed, and continuously. Flimsiness of such long strands makes automatic handling thereof extremely difficult, particularly as respects wires of different length and sizes. There is need for equipment capable of automatically stacking such cut and/or stripped strands, and with precision.

SUMMARY OF THE INVENTION

It is a major object of the invention to provide apparatus and method capable of handling and stacking elongated strands so as to overcome the above, as well as other problems encountered in automatic processing of wire of different sizes, lengths, and flimsiness.

Basically, the stacker apparatus of the invention includes:

(a) conveyor means having an elongated endwise traveling stretch onto which the strand is fed to be carried endwise on said stretch, (b) gripper means to grip a medial portion of the strand as forward extent of the strand is carried endwise on the stretch, (c) means to effect displacement of said gripper means to a position locating the gripped portion of the strand sufficiently out of alignment with the stretch that the strand is progressively pulled sidewardly off the stretch in response to endwise travel of the stretch relative to the strand.

As will appear, the gripper means may typically comprise a clamp having a first position in which the clamp operates to grip the medial portion of the strand as the strand travels past the gripper means, and a second position in which the clamp continues to grip the strand medial portion and until the strand is pulled free of said stretch, the clamp then releasing the strand for stacking; and more particularly the gripper means may comprise (i) a rotor, and fixed and movable pairs of jaws carried by the rotor, and (ii) cam means operatively connected with movable jaws to cause them to move between wire strand gripping and releasing positions as the rotor rotates, intermittently. A collector is provided at a lower level relative to said stretch, and into which the strand falls upon its release by the clamp.

In additional, means is provided to feed the wire strand for travel toward the gripper means and the conveyor means, and the wire is typically cut to length as it is so fed.

It is a further object to provide a lengthwise forwardly and downwardly inclined slide along which the strand travels prior to arrival at said conveyor means, and along which rearward extent of the strand travels as forward extent of the strand is carried by the conveyor means. As will appear, the slide is supported for movement acting to sidewardly discharge rearward extent of the strand off the slide in conjunction with the pulling of forward extent of the strand sidewardly off the conveyor means.

A still further object includes the provision of barrier fingers traveling with said stretch and positioned to urge the strand off the stretch as the stretch travels endwise relative to the strand during gripping of the strand by the gripper means at a location out of alignment with the stretch. Such fingers may be attached to the conveyor belt, and may be flexible and bendable so as not to injure the wire strand being pulled off the conveyor. Also the mounting of the fingers is highly advantageous in that they can be easily replaced in the field if worn or damaged.

A unique transition system allows strands to be guided from one conveyor unit to a following, or down stream, conveyor unit; and a strand guide cone is provided to allow strand entry into the cone at the position dictated by its guide. It "sees" the cone as a solid cone with no way to escape; but, as the strand drops out of its guide to a lower level, the strand has free exit out the front of the cone, as will be seen.

These and other objects and advantages of the invention, as well as the details of an illustrative embodiment, will be more fully understood from the following specification and drawings, in which:

DRAWING DESCRIPTION

FIG. 1 is an elevation showing overall apparatus incorporating the invention, for stacking wire;

FIG. 1*a* is a cross-section through a typical wire;

FIG. 2 is an elarged section taken on lines 2—2 of FIG. 1;

FIG. 5 is an fragmentary section on lines 5—5 of FIG. 3;

FIG. 8 is an elevation taken on lines 8—8 of FIG. 7;

DETAILED DESCRIPTION

Figures 1, 1A:
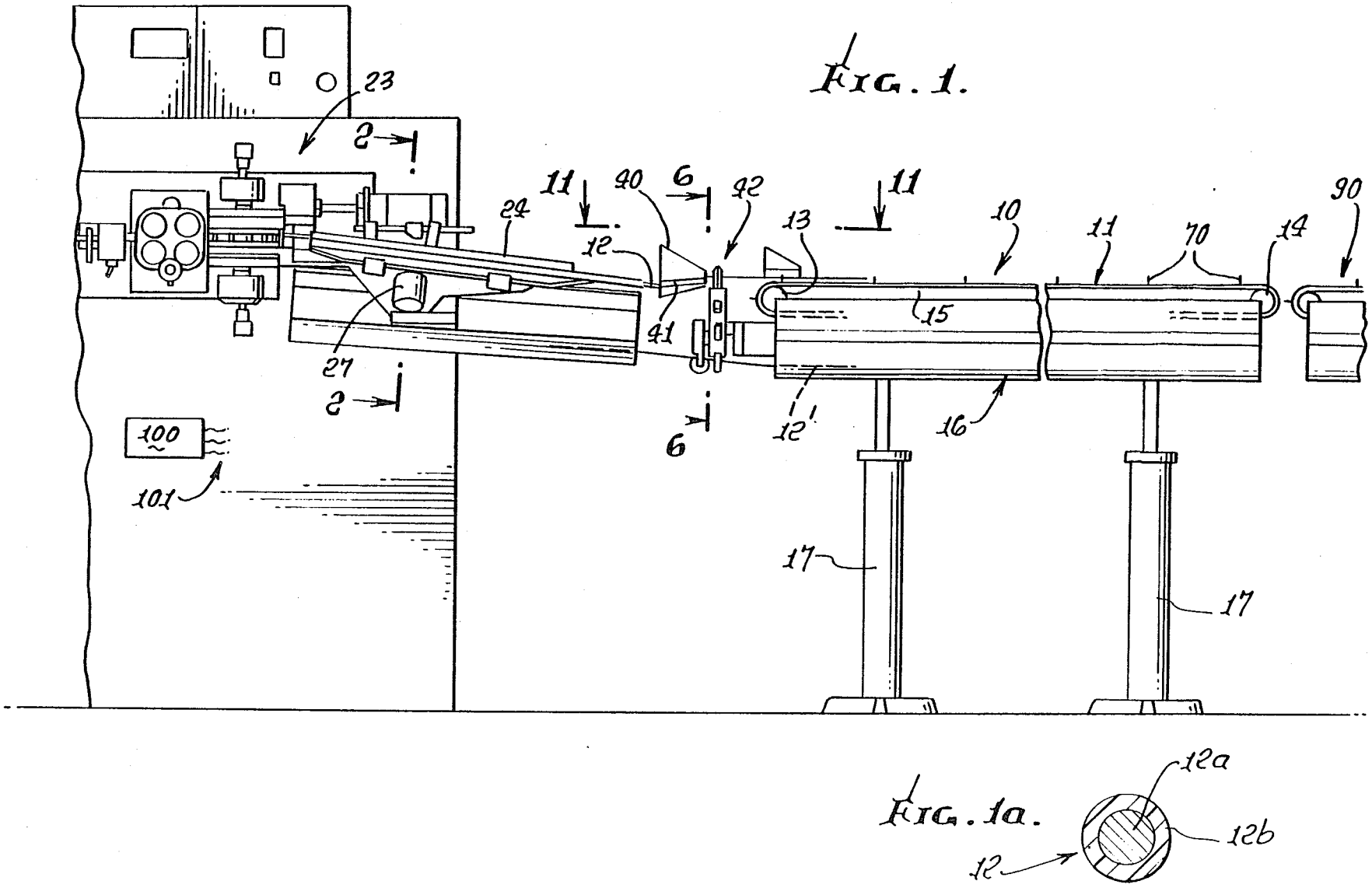

In FIGS. 1 and 11-16, conveyor means 10 has an elongated endwise traveling upper stretch 11*a* onto which a wire strand 12 is fed to be carried endwise (to the right in FIG. 1) on that stretch, in frictional contact with same. For this purpose, the conveyor may comprise an endless belt 11 of tough fabric material acting to frictionally retain and transport the wire on the top surface of belt upper stretch 11*a*, which travels rightwardly in FIG. 1. As seen in FIG. 1*a*, a typical flimsy wire strand 12 has a cross section that includes a metallic wire core 12*a*, and non-metallic insulation sheath 12*b* about the core.

The conveyor means 10 also includes lengthwise spaced rollers 13 and 14 about which the belt 11 is entrained, the belt including upper stretch 11*a* sliding on a support table 15, and the belt lower stretch 11*b* travelling below that table. Frame structure 16 carriers the table and rollers, and is in turn supported by standards 17. A drive for the conveyor includes motor 18, pulley 19 carried by the motor shaft 18*a*, pulley 20 carried by shaft 13*a* attached to roller 13, and belt 21 entrained on pulleys 19 and 20.

Figure 3:
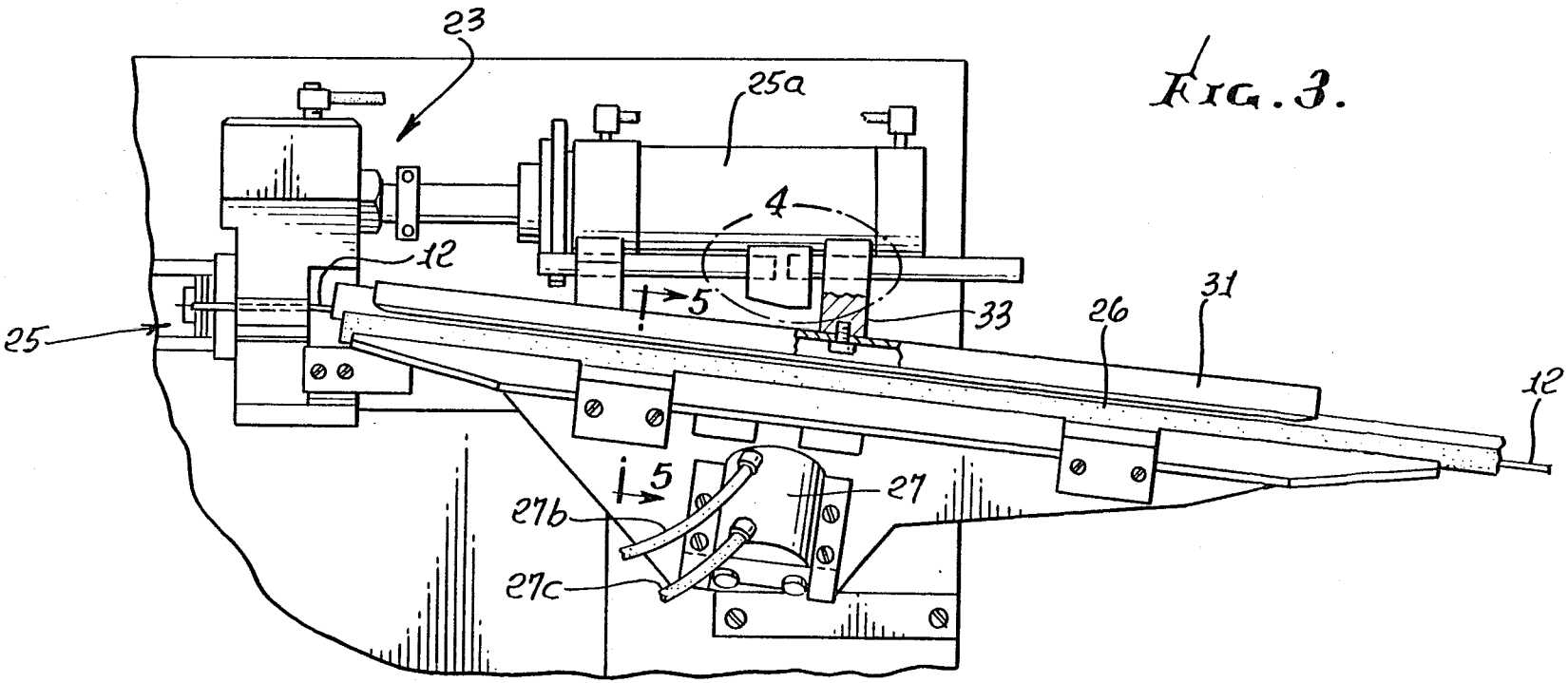
FIG. 3 is an elevation taken on lines 3—3 of FIG.2.

The wire strand 12 is fed onto the belt upper stretch 11*a* in a rightward direction in FIG. 1, to be carried rightwardly on that stretch. Apparatus to feed the wire to the the belt is indicated generally in FIG. 1 to include wire feeding, cutting, and insulation stripping mechanism 23, and elongated guide mechanism 24. Cutting and stripping of the selected wire strand length at its trailing end is effected by means indicated at 25 in FIG. 3. An actuator 25*a* operates the cutters and stripper, of conventional construction. Forwardly of that location, the wire travels or slides forwardly and downwardly along a slide 26 better seen in FIGS. 2, 3 and 5, and inclined lengthwise forwardly and donwardly, generally toward the conveyor means.

Figure 4:
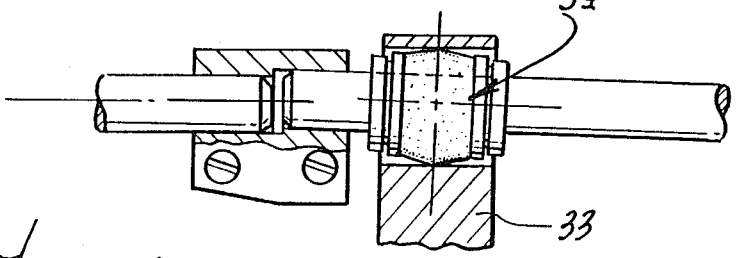
FIG. 4 is an enlarged, fragmentary view, in section, showing a support indicated by lines 4—4 in FIG. 3.

Means is provided for supporting the slide for movement acting to sidewardly discharge rearward extent of the strand off the slide in conjunction with pulling of forward extent of the strand sidewardly off the conveyor means, as will be described. In the example, such means includes an actuator 27 operatively connected to the slide to displace it sidewardly into a strand discharging position. See for example the raised position of the slide, in full lines 26 in FIG. 5, and downwardly displaced or lowered position of the slide, for strand discharge, and as indicated by broken lines 26' in FIG. 5. An actuator plunger 27*a* pivotally connects at 28 to a link 29 attached to the slide. The slide may pivot about an axis 30. A lengthwise extending tunnel 31, having inverted U-shaped cross-section, extends lengthwise over and along the slide to laterally confine the wire strand when the strand is traveling forwardly and downwardly toward the conveyor means. When the flapper type slide has moved to position 26', it is displaced away from the fixed position tunnel, to allow lateral discharge of the strand rearward extent, i.e. downwardly into a trough type collector 31, wherein previously cut-to-length strands have been collected, as at 12'. Structure supporting the tunnel and slide appear at 32 in FIG. 2, and includes a holder indicated at 33 in FIG. 3. Bearing support for the holder appears at 34 in FIG. 4. Actuator 27 may comprise an air cylinder, with air hose connections at 27*b* and 27*c*.

Figure 11:
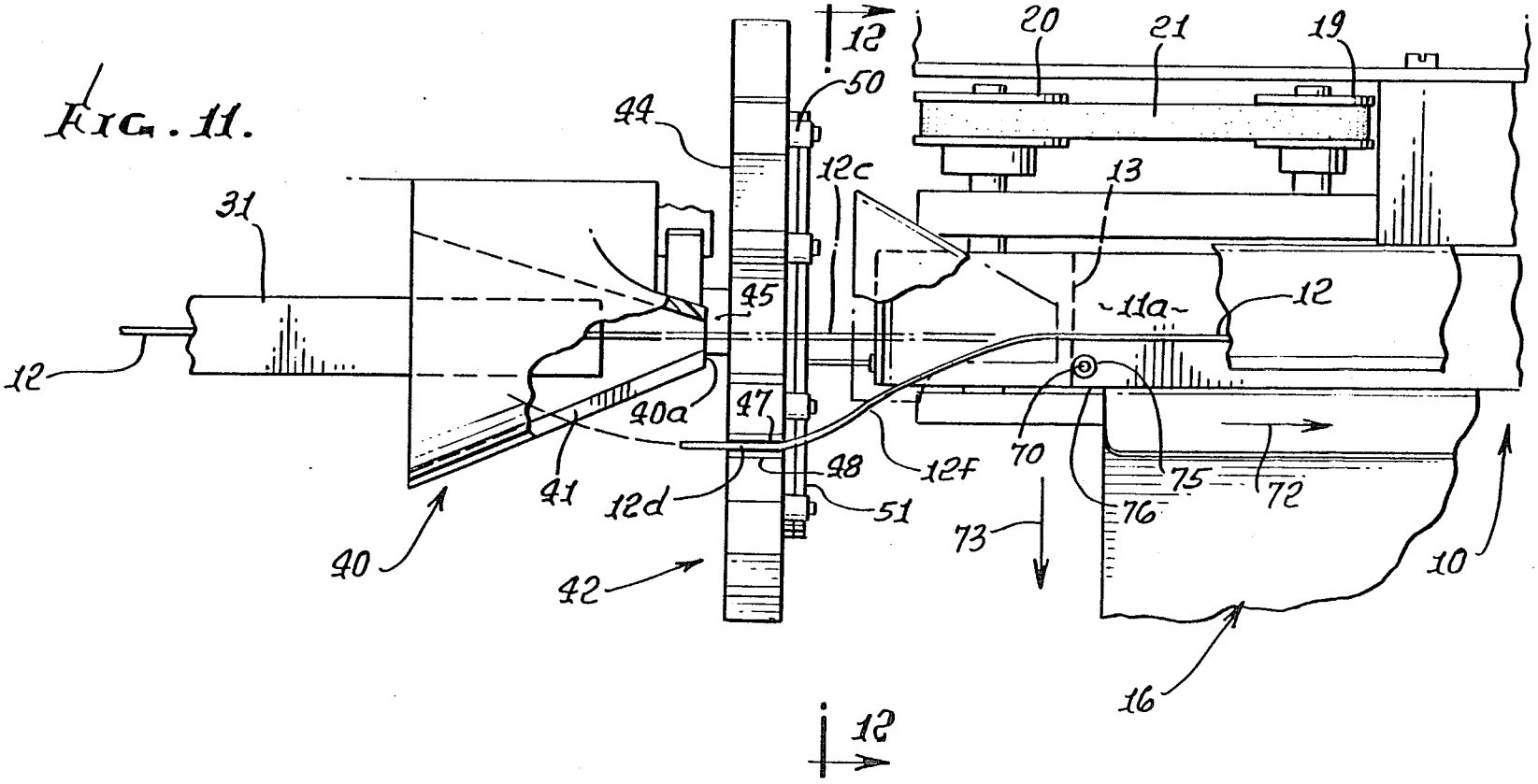
FIG. 11 is an enlarged plan view on lines 11—11 of FIG. 1.

The means to feed the strand toward the top stretch 11*a* may not only include the gravity slide strucure as described, aiding forward travel of the flimsy wire strand, but also a funnel shaped guide 40 located between the forward end of the slide, and the wire loading rearward end of the stretch 11*a*. Funnel guide 40 is cone shaped, it tapers forwardly, and it opens forwardly at its small end 40*a* to accurately guide the wire strand into position to be gripped by gripper means indicated at 42. Also, the funnel guide has a slit 41 extending along its length for sidewardly discharging wire extent from within the funnel, when the strand is gripped and displaced sidewardly so that it may be pulled off the conveyor means 10, and off the slide 26, into the troughs 16 and 31, for stacking in a cluster or bundle with other previously cut strands. Tunnel 31 may extend into and terminate within the funnel guide, as seen in FIG. 11.

Figure 12:
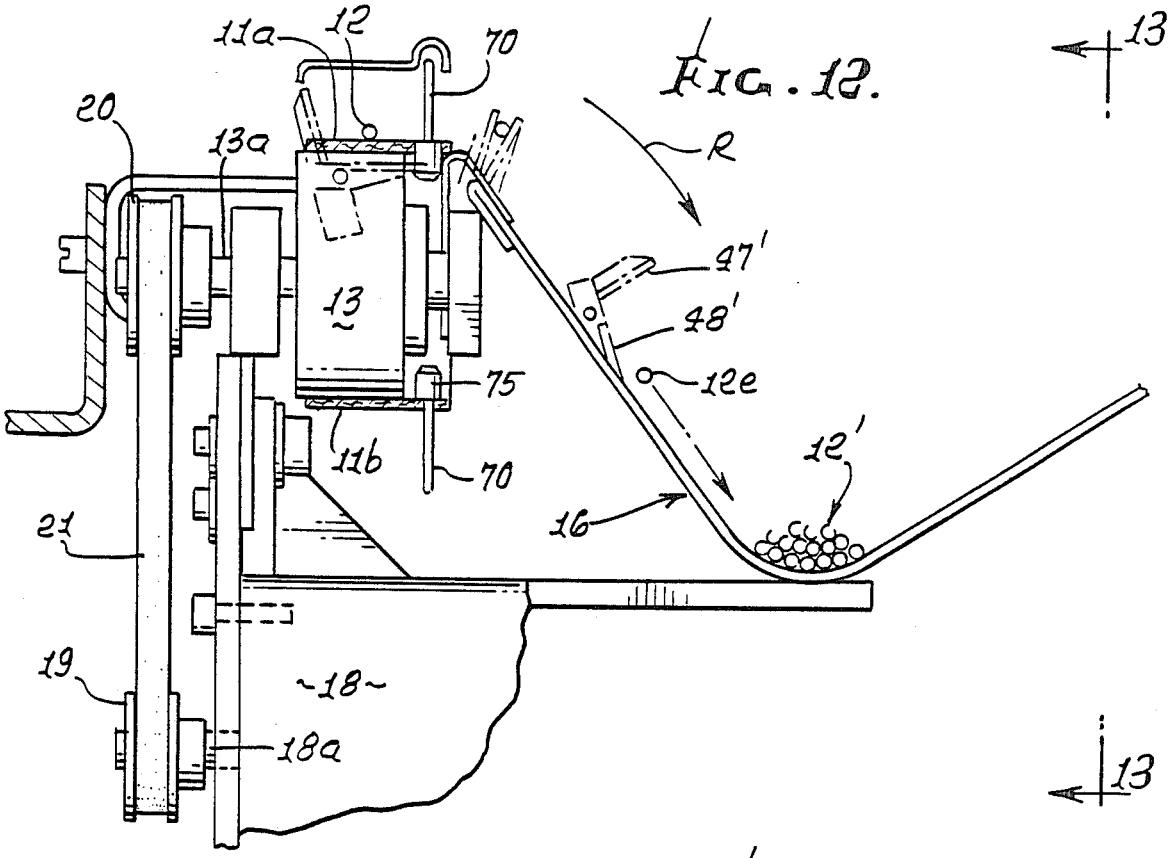
FIG. 12 is a section taken on lines 12—12 of FIG. 11.
Figure 13:
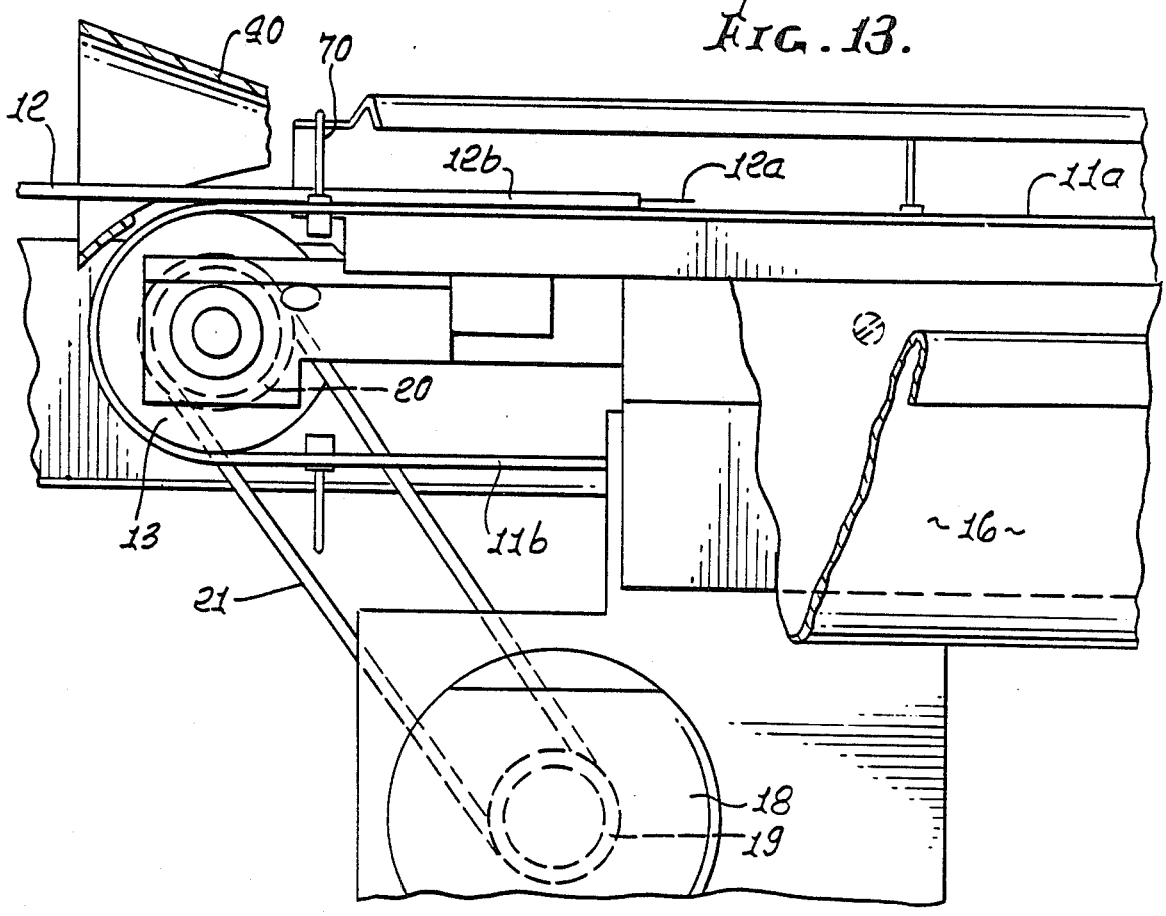
FIG. 13 is an elevation taken on lines 13—13 of FIG. 12.

The gripper means 42 serves to grip a medial portion of the strand as forward extent of the strand is carried endwise on the conveyor upper stretch 11*a*. See for example FIG. 11 wherein the gripper grips wire strand extent 12, first at its broken line forward travel location 12*c*, and also as the strand section is displaced sidewardly to location 12*d*, enabling the strand on the conveyor to be pulled off the conveyor, as by travel of barrier fingers on the conveyor. Note that as the strand is displaced from travel position 12*c* to arrested forward travel location 12*d*, the strand is positively pulled or displaced sidewardly through the slit 41 in the conical funnel guide 40, thereby to be positioned to drop by gravity into the troughs, when the gripper means releases the wire strand. See FIG. 12, showing the released wires strand 12*e* dropping into the trough or collector 16.

Figure 6:
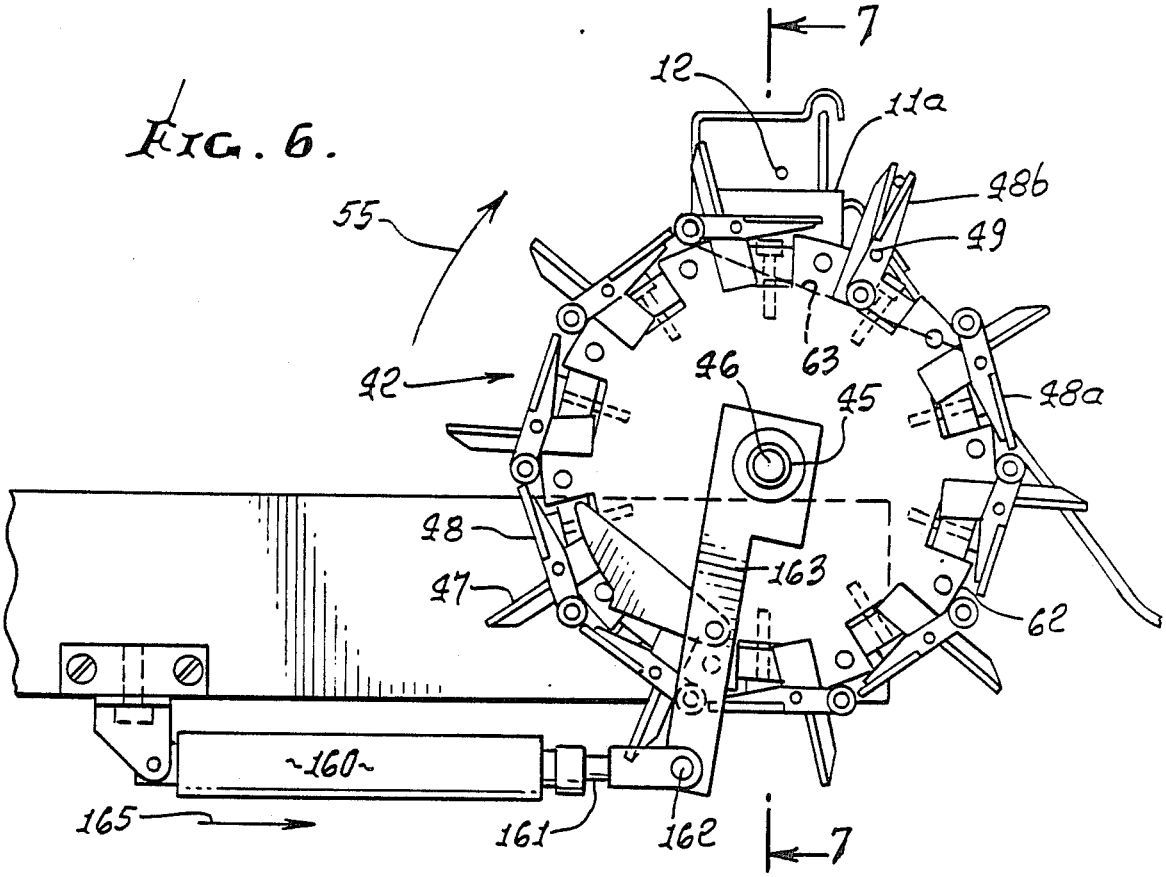
FIG. 6 is an enlarged elevation taken in section on lines 6—6 of FIG. 1.
Figure 7:
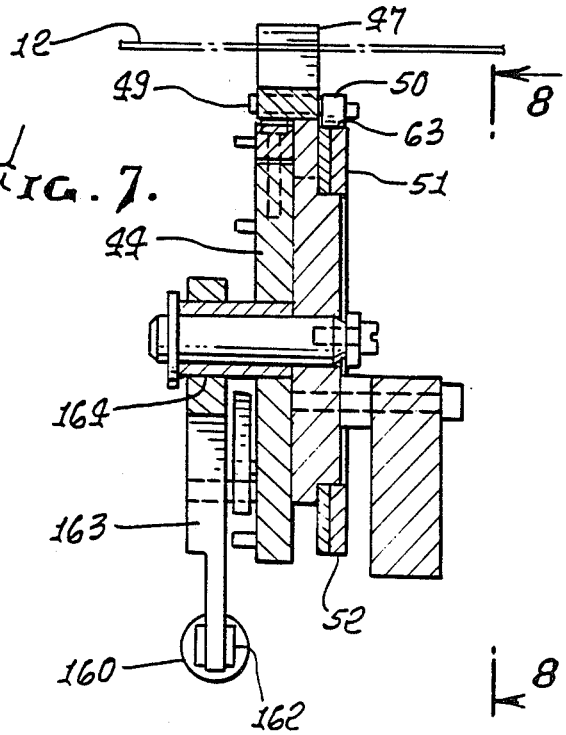
FIG. 7 is a section taken on lines 7—7 of FIG. 6.
Figure 9:
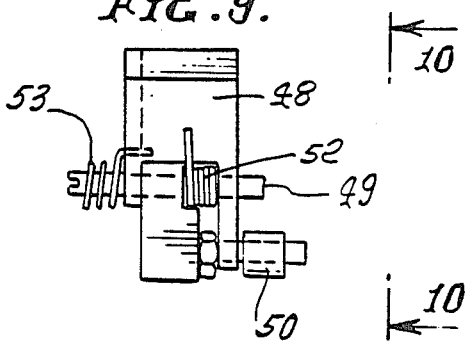
FIG. 9 is an enlarged elevation showing gripper finger details.
Figure 10:
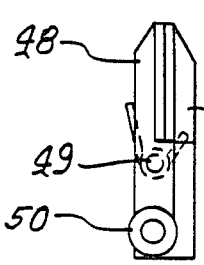
FIG. 10 is an elevation taken on lines 10—10 of FIG. 9.

The gripper means may advantageously take the form shown in FIGS. 6–12, to include a rotor 44 pivotally mounted for rotation at 45, and about an axis 46 extending forwardly in the direction of the conveyor. The rotor carries, multiple like pairs of gripper jaws 47 and 48, each jaw 47 peripherally fixed to the rotor 40 project outwardly at the rotor periphery. Jaws 48 are pivotally mounted to the rotor at locations 49. As the rotor rotates, the jaws 48 are pivoted by cam structure between open positions, seen at 48*a*, in which they extend generally tangentially to the rotor periphery, and closed position, seen at 48*b* in which jaw 48 co-acts with jaw 47 to grip the wire strand. Cam followers 50 carried by the jaw 48 ride on the cam periphery of the cam plate 51, and are urged against that cam periphery as by torsion springs 52 and 53 associated with pivots 49. The cam periphery or surface has a circular portion 62, and a flat segment portion 63. As the rotor rotates, the followers 50 engaging the circular cam surface portion 52 allows the jaws 48 to be in open positions 48*a*, as seen in FIG. 1, and the flat segment portion causes the jaws 48 to be in closed positions 48*b*, successively, as also seen in FIG. 6. Thus, as rotor rotation, indicated by arrow 55 carries a jaw 48 toward top center position with its follower on surface 62, the jaw is open, to receive the wire strand between it and its associated jaw 47. Thereafter, as the rotor is rotated, the follower 50 travels along segment surface 63, to cause the jaw to close toward jaw 47, to grip the wire strand section 12*c*. The strand section is then displaced, rotatably, and is released by opening of jaw 48 to allow the strand to fall. See strand release jaw position shown in broken lines 48' in FIG. 12.

Actuator means to effect displacement of the gripper means may include a linear actuator 160 having a plunger 161 pivotally attached at 162 to a crank 163 respectively. The latter is suitably ratchet or clutch connected at 164 to the rotor 44. Thus, the rotor is angularly incrementally rotated in one direction as the actuator is successively actuated to extend plunger 161 in direction 165, the crank 163 being disconnected to the rotor, by the clutch, during plunger 161 retain stroking. Thus, a unidirectional, incremental drive to the rotor is provided.

Note in FIG. 11 that the gripped strand portion in position 12*d* remains in that position, out of alignment with the stretch 11*a*, so that the strand length thereon is progressively pulled sidewardly off the stretch 11*a* in response to endwise travel of the stretch 11*a* relative to the now retained strand. It is only after completion of pulling of the strand off the conveyor stretch 11*a* that the rotor is again rotated incrementally (see R in FIG. 12) to cause jaw 48 to pivot away from jaw 47, to release the strand.

In this connection, pulling or urging of the strand laterally off the stretch 11*a* may advantageously be effected by barrier fingers 70 traveling with the conveyor belt. Alternatively, the fingers act to block sideward displacement off the stretch 11*a* of strand length on that stretch and traveled forwardly thereby. FIG. 11 shows that when the strand is gripped and displaced to position 12*d* by the gripper means, a finger 70 is carried up by roller 13 to approach the laterally deviated portion 12*f* of the strand, so that as that finger 70 then travels forwardly with the stretch in direction 72, the strand is progressively displaced or pulled in direction 73 away from the stretch, i.e. the strand is pulled off the stretch to drop into the collector. Multiple fingers 70 are mounted at 75 to the conveyor belt, adjacent the edge 76 thereof off which the strand is to be pulled or displaced. The fingers are flexible, or they are flexibly mounted, so as to bend relative to the belt, whereby risk of injury to the strand during pull off the stretch is eliminated.

Figure 14:
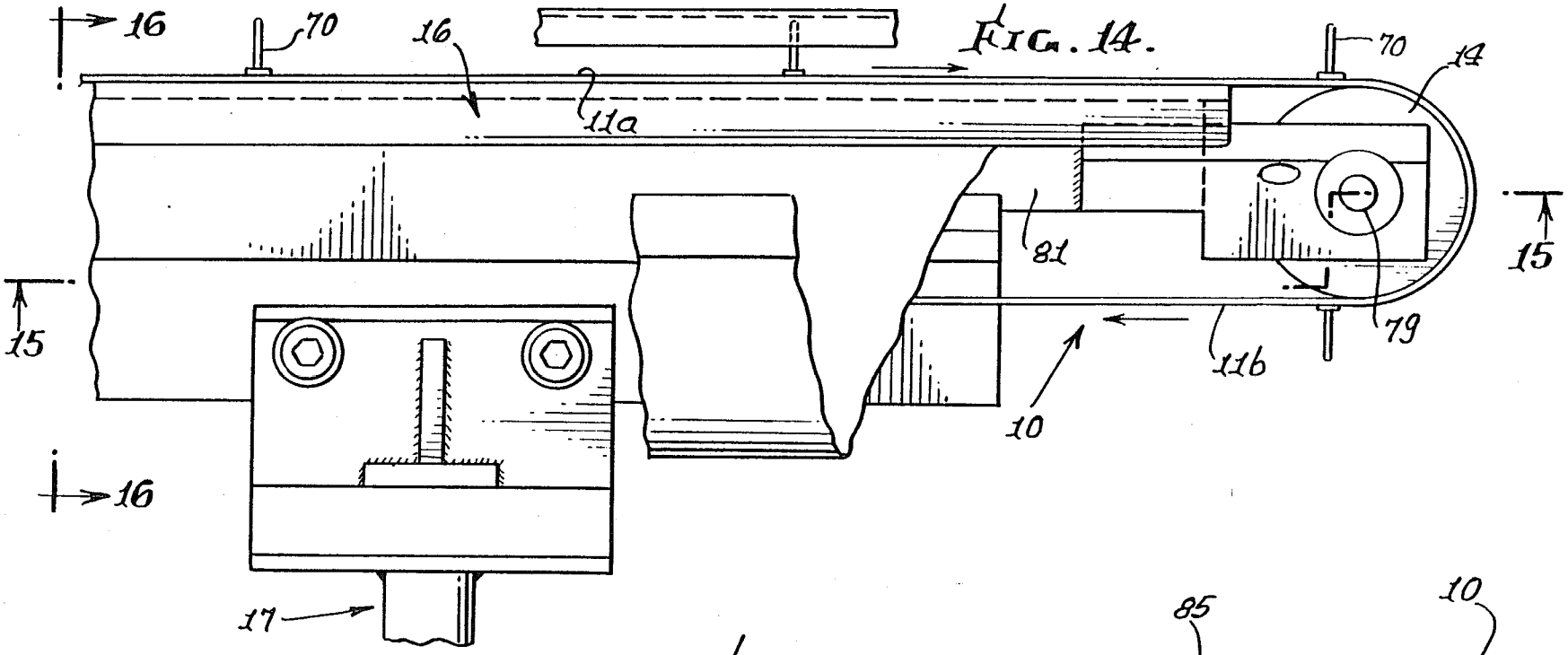
FIG. 14 is an enlarged view, in elevation, showing details of the wire conveyor.
Figure 15:
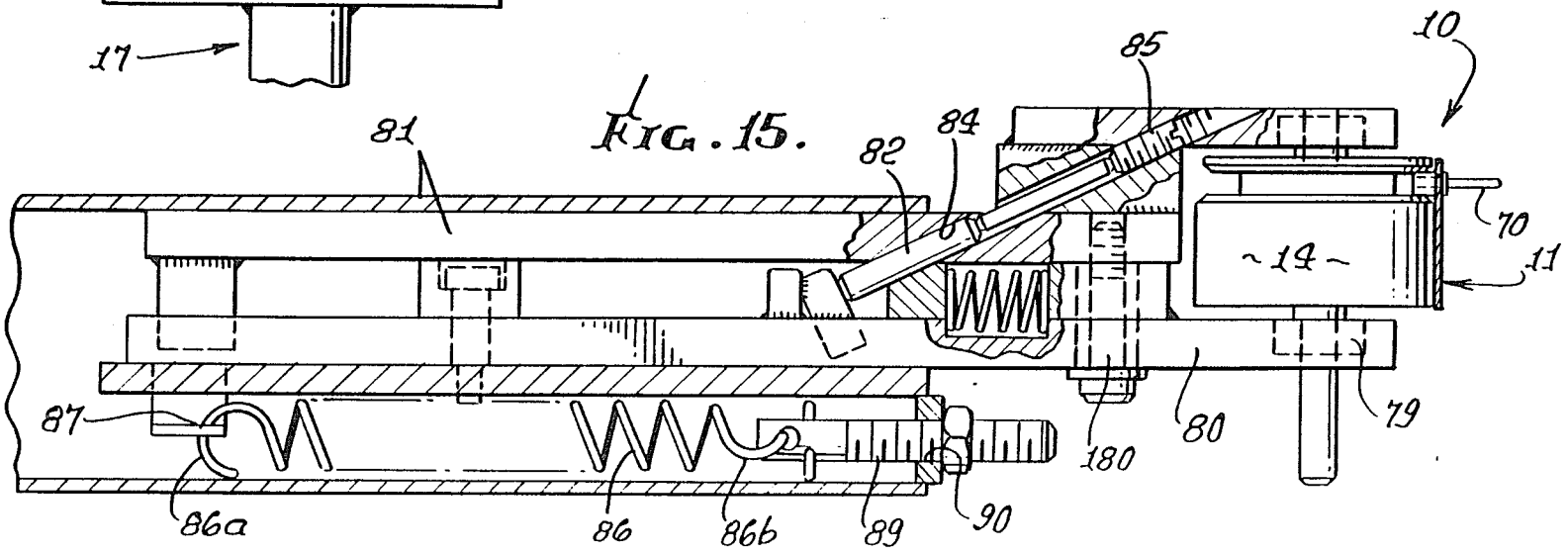
FIG. 15 is a plan view looking upward, taken on lines 15—15 of FIG. 14.
Figure 16:
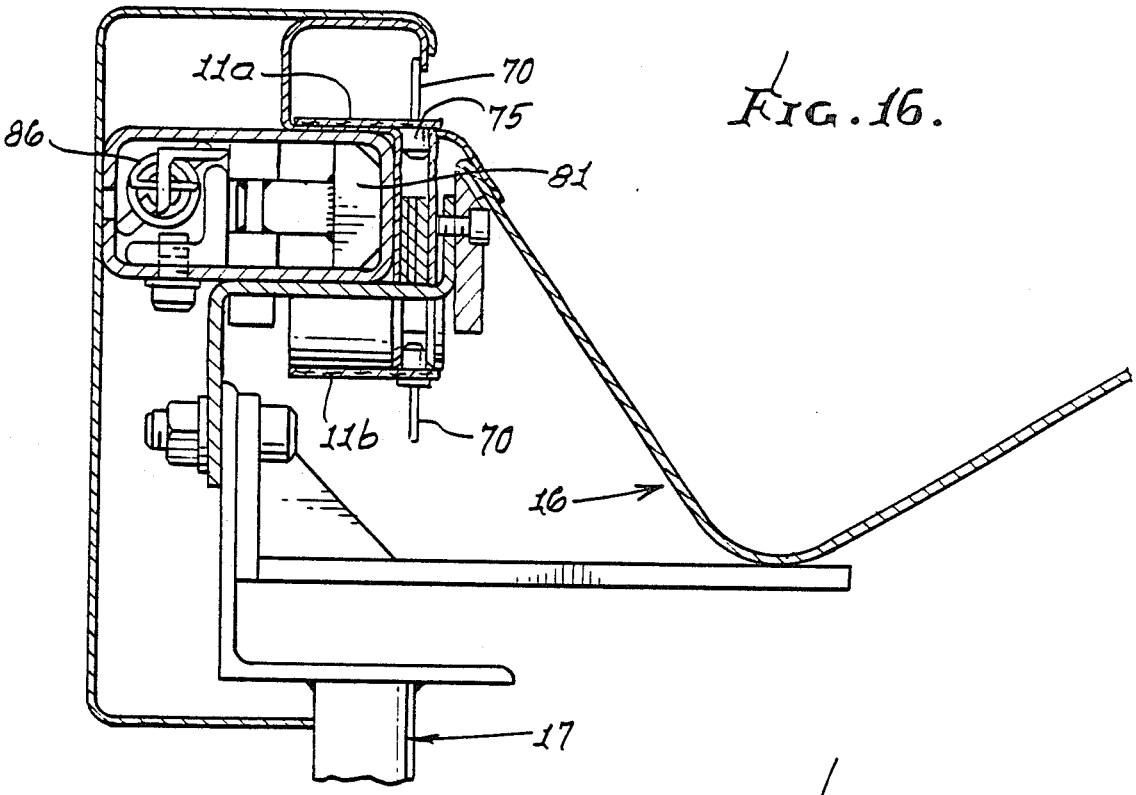
FIG. 16 is an elevation taken in section, on lines 16—16 of FIG. 14.

Provision for adjustment of the conveyor to vary the tension in the belt stretches, i.e. to take up any belt slack, is shown, for example, in FIGS. 14 and 15. As indicated, roller 14 is rotatably mounted at 79 to a slide 80 linearly movable relative to support structure 81. A pin 82 is adjustable in bore 84 in structure 81, to urge the latter leftwardly. Set screw 85 bears against the outer end of the pin, to vary its position in the bore. Tension spring 86 has one end 86*a* attached to the slide, at 87, and its opposite end 86*b* attached to structure 81, via adjustable part 89 threaded in bore 90.

The term "strands" x-ray also apply to other flimsy, elongated, narrow, flexible bodies such as ropes, cords, tubes and the like.

Figure 17:
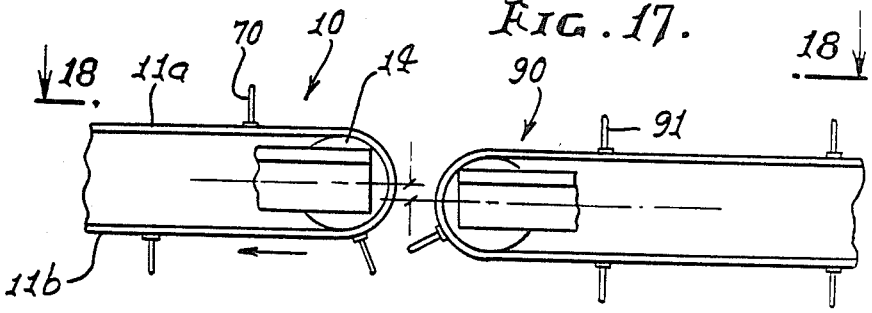
FIG. 17 is an elevation showing the relationship between successive wire conveyors.
Figure 18:
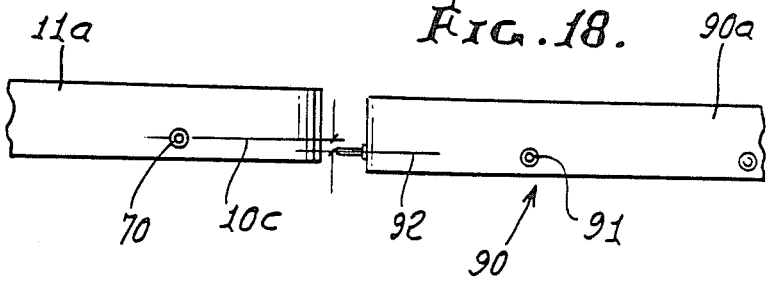
FIG. 18 is a plan view taken on lines 18—18 of FIG. 17.

FIGS. 17 and 18 show the relationship between successive wire conveyors, labeled 10 and 90, for wire strands. Note fingers 91 shown on conveyor 90, like fingers 70, and traveling offset path 92. The top of conveyor 90 is shown at 90*a*.

We claim:

1. In a flexible strand stacker, the combination comprising (a) conveyor means having an elongated endwise traveling stretch onto which the strand is fed to be carried endwise on said stretch, (b) gripper means to grip a trailing portion of the strand as forward extent of the strand is carried endwise on the stretch, (c) means to effect dispalcement of said gripper means to a position locating the gripped portion of the strand sufficiently out of alignment with the stretch that the strand is progressively pulled sidewardly off the stretch in response to endwise travel of the stretch relative to the strand, (d) and barrier means acting to block sideward displacement off said stretch of strand length on the stretch.

2. The combination of claim 1 wherein said barrier means comprises spaced barrier fingers traveling with said stretch.

3. The combination of claim 2 wherein said measn to effect said displacement of said gripper means is located to grip a mid-portion of the strand that has not yet been fed onto the stretch.

4. The combination of claim 2 wherein said fingers are flexible so as to bend relative to the stretch as they travel with the stretch.

5. The combination of claim 1 wherein said gripper means comprises a clamp having a first position in whch the clamp operates to grip the trailing portion of the strand as the strand travels past the gripper means, and a second position in which the clamp continues to grip the strand trailing end portion and until the strand is pulled free of said stretch, the clamp then releasing the strand for stacking.

6. The combination of claim 5 including a collector at a lower level relative to said stretch, and into which the strand falls upon its release by the clamp.

7. The combination of claim 1 including cutter means to cut the strand to pre-selected length as the strand is fed toward said stretch.

8. The combination of claim 7 including means to feed the strand for travel toward the gripper means and said stretch, including a sidewardly slit conical guide.

9. The combination of one of claims 1, or 6 or 8, wherein the strand comprises a flimsy wire.

10. In a flexible strand stacker, the combination comprising (a) conveyor means having an elongated endwise traveling stretch onto which the strand is fed to be carried endwise on said stretch, (b) gripper means to grip a trailing portion of the strand as forward extent of the strand is carried endwise on the stretch, (c) means to effect displacement of said gripper means to a position locating the gripped portion of the strand sufficiently out of alignment with the stretch taht the strand is progressively pulled sidewardly off the stretch in response to endwise travel of the stretch relative to the strand, (d) and including a lengthwise forwardly and downwardly inclined slide along which the strand travels prior to arrival at said conveyor means and along which rearward extend of the strand travels as forward extend of the strand is carried by the conveyor means.

11. The combination of claim 10 including means supporting the slide for movement acting to sidewardly discharge rearward extent of the strand off the slide in conjunction with the pulling of forward extent of the strand sidewardly off the conveyor means.

12. The combination of claim 11 wherein said means supporting the slide includes an actuator operable to displace the slide sidewardly into a strand discharging position.

13. The combination of claim 12 including a lengthwise extending tunnel extending over the slide to confine the strand when the slide is in a first position for strand travel therealong, the slide downwardly displaced relative to the tunnel when in strand discharging position.

14. In a flexible strand stacker, the combination comprising (a) conveyor means having an elongated endwise traveling stretch onto which the strand is fed to be carried endwise on said stretch, (b) gripper means to grip a trailing portion of the strand as forward extent of the strand is carried endwise on the stretch, (c) means to effect displacement of said gripper means to a position locating the gripped portion of the strand sufficiently out of alignment with the stretch that the strand is progressively pulled sidewardly off the stretch in response to endwise travel of the stretch relative to the strand, (d) and including:

(i) a rotor, and fixed and movable pairs of jaws carried by the rotor, and (ii) cam means operatively connected with movable jaws to cause them and move between wire strand gripping and releasing positions as the rotor rotates.

15. The combination of claim 14 wherein said cam means includes a cam element having a cam surface extending about one axis defined by the rotor, and cam followers carried by the movable jaws to engage said cam surface, the movable jaws pivotally carried by the rotor to cause the movable jaws to pivot between said wire strand gripping and releasing positions as the rotor rotates relative to said cam element.

16. The combination of claim 15 wherein said means to effect displacement of the gripper means includes a unidirectional, incremental drive connected to the rotor.

17. The combination of claim 14 including barrier fingers traveling with said stretch and positioned to urge the strand off the stretch as the stretch travels endwise relative to the strand during gripping of the strand by the gripper jaws at a location out of alignment with the stretch.

18. The combination of claim 17 including an additional conveyor means beyond the first mentioned conveyor means with fingers on the additional conveyor means offset in their travel path from the travel path of the fingers on the first mentioned conveyor means.

19. The combination of claim 1 including mechanism cutting and stripping the wire strand which is then fed to said conveyor means, said conveyor means extending in the path of travel of the wire subjected to cutting and stripping by said mechanism.

20. In the method of stacking a flexible strand, and employing conveyor means, and gripper, means, the steps that include:

(a) feeding the strand endwise onto an elongated endwise traveling stretch to be carried endwise on said stretch, (b) causing the gripper means to grip a trailing portion of the strand as forward extend of the strand is carried endwise on the stretch, (c) effecting displacement of said gripper means to a position locating the gripped portion of the strand sufficiently out of alignment with the stretch that the strand is progressively pulled sidewardly off the stretch in response to endwise travel of the stretch relative to the strand, and blocking sideward displacement of said stretch of strand length on the stretch by providing traveling barrier means with said stretch.

21. The method of claim 20 wherein said effecting displacement step is carried out to grip a portion of the strand that has not yet been fed onto the stretch, the barrier means providing barrier fingers traveled in sequence in the direction of said stretch.

22. The method of claim 20 wherein said gripper means comprises a clamp and including displacing the clamp betwene a first position in which the gripper grips the trailing portion of the strand as the strand travels past the gripper means, and a second postion in which the clamp continues to grip the strand trailing portion and until the strand is pulled free of said stretch, the clamp then releasing the strand for stacking.

* * * * *